US006799493B2

(12) United States Patent
Wang

(10) Patent No.: US 6,799,493 B2
(45) Date of Patent: Oct. 5, 2004

(54) OPEN END WRENCH

(76) Inventor: Ching-Shu Wang, No. 8-5, Lane 433, Ta-Li Rd., Ta-Li City, Tai-Chung Hsien (TW)

( * ) Notice: Subject to any disclaimer, the term of this patent is extended or adjusted under 35 U.S.C. 154(b) by 0 days.

(21) Appl. No.: 10/314,063

(22) Filed: Dec. 5, 2002

(65) Prior Publication Data

US 2004/0107804 A1 Jun. 10, 2004

(51) Int. Cl.[7] ..... B25B 13/22
(52) U.S. Cl. ..... 81/135; 81/145; 81/357
(58) Field of Search ..... 81/134–137, 145–147, 81/357–360, 366, 337–340

(56) References Cited

U.S. PATENT DOCUMENTS 2,719,448 A * 10/1955 Bugge ..... 81/145
3,817,128 A * 6/1974 Evans ..... 81/145
4,735,121 A * 4/1988 Coulson ..... 81/129

* cited by examiner

*Primary Examiner*—Debra Meislin
(74) *Attorney, Agent, or Firm*—Charles E. Baxley

(57) ABSTRACT

An open end wrench including a fixed jaw and a movable jaw keeping between them a constant relation of lateral slide to each other; a fluted surface being provided at the lower edge of the movable jaw; a spring being adapted between two jaws to define a clamping space under normal status; a locking gear permitting reciprocally flexible circulation having a ratchet to engage the fluted surface of the movable jaw under normal status and a dialer to keep the ratchet separating from the fluted surface being respectively provided at both ends.

13 Claims, 4 Drawing Sheets

OPEN END WRENCH

BACKGROUND OF THE INVENTION (a) Field of the Invention

The present invention is related to an open end wrench, and more particularly, to an improved structure of an adjustable opening size to allow inching, fixed opening, automatic release of work piece and easy operation.

(b) Description of the Prior Art

Whereas as illustrated in FIG. 1 of the accompanying drawings, a conventional open end wrench has a fixed size of its opening, meaning, a set of wrenches in different sizes must be prepared depending on the size of the individual work piece. However, the drawbacks are that it is not convenient to carry along the set of wrenches and that frequent change among wrenches of various sizes is required. Another wrench as shown in FIG. 2 allows reciprocal movement of a movable jaw by turning a thumbscrew to form a clamping space with a fixed jaw to clamp on a work piece. However, it prevents fast and convenient operation since the operator has use his fingers to operate a thumbscrew either for clamping or releasing the work piece. Furthermore, the peripheral of the thumbscrew is made slightly higher than the surface of the wrench for easier contact by fingers of the operator; but the thumbscrew is at the same time vulnerable to be contacted by objects close to it to cause the movable jaw to open up, thus to lose the clamping of the work piece. Consequently, it becomes extremely inconvenient since frequent adjustment of the thumbscrew is required to control the clamping space.

SUMMARY OF THE INVENTION

The primary purpose of the present invention is to provide an improved structure of an open end wrench comprised of a fixed jaw and a movable jaw that allows laterally reciprocal movement. While clamping a work piece, the movable jaw is pushed inwardly and then restricted by a locking gear to fix a clamping space; while releasing the work piece, the locking gear is dialed to allow the movable jaw to automatically clear away from the work piece.

Another purpose of the present invention is to provide an improved structure of an open end wrench that is compact, allowing easy manufacturing and assembly and excellent control of its precision.

To achieve the purposes, the present invention is essentially comprised of a fixed jaw and a movable jaw with both sharing a constant relation of relatively lateral slide against each other and a fluted surface is provided at the lower edge of the movable jaw; a spring provided between the fixed jaw and the movable jaw having one end fixed to the fixed jaw and the other end fixed to the movable jaw to define a clamping space under normal status by the clamping parts respectively from the movable and the fixed jaws due to the tension provided by the spring; and a locking gear allowing reciprocal and flexible circulation made in V-shape and having one end provided with a ratchet to engage the fluted surface of the movable jaw and the other end provided with a dialer to control the ratchet to clear away from the fluted surface.

DETAILED DESCRIPTION OF THE PREFERRED EMBODIMENTS

Figure 1:
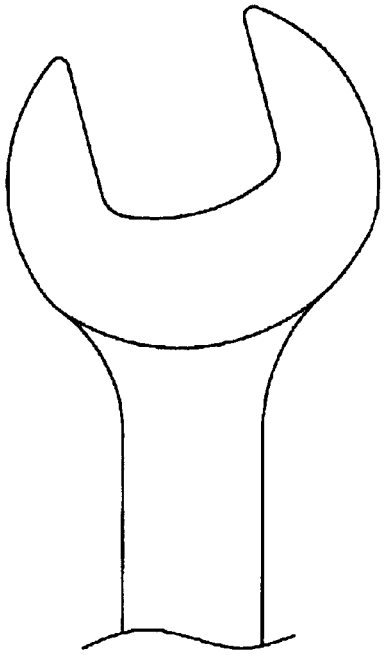
FIG. 1 PRIOR ART
FIG. 1 is a view showing a local part of an open end wrench of the prior art.
Figure 2:
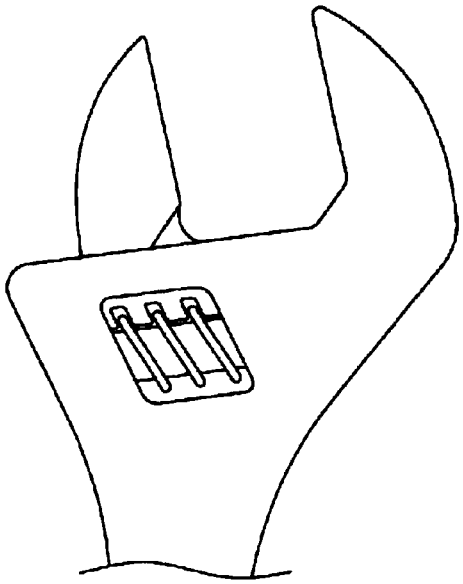
FIG. 2 PRIOR ART
FIG. 2 is a view showing a local part of another open end wrench of the prior art.
Figure 3:
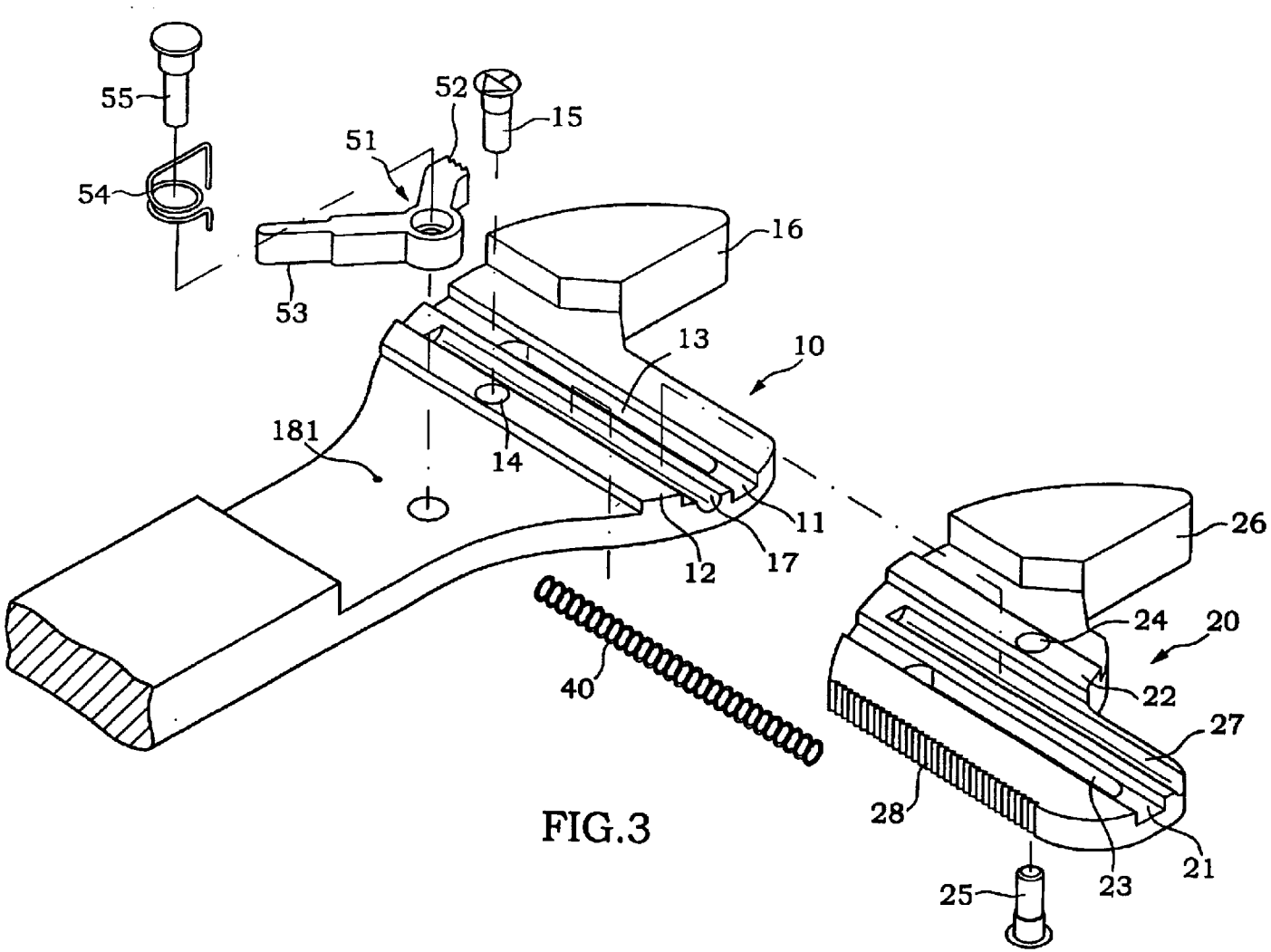
FIG. 3 is an exploded view of a preferred embodiment of the present invention.
Figures 4A, 4B:
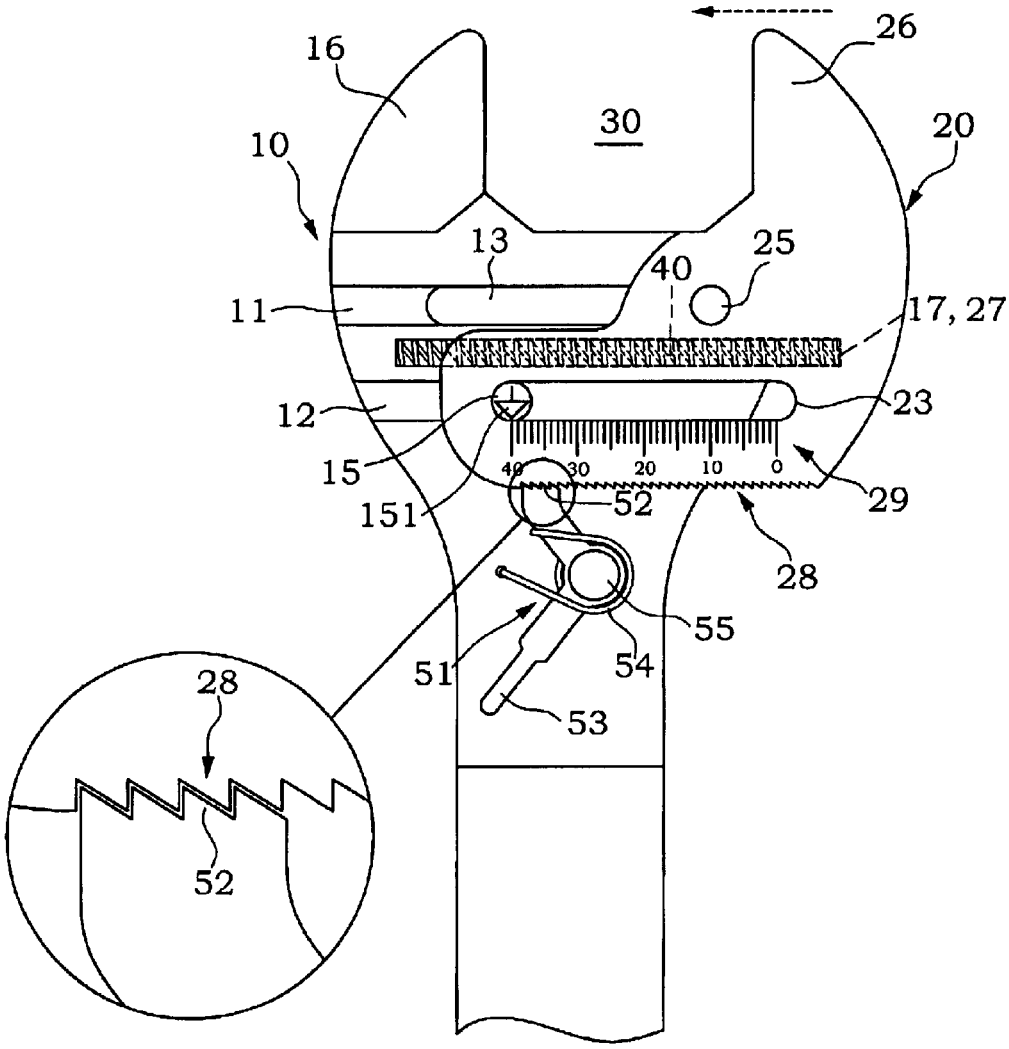
FIG. 4A is a view showing the appearance of the preferred embodiment of the present invention as assembled.
FIG. 4B is a blowout view of a local part taken from FIG. 4A.

Referring to FIGS. 3 and 4A, a preferred embodiment of the present invention is essentially comprised of a fixed jaw (10) and a movable jaw (20) with both provided at a work end of the handle of a wrench. Two lateral channels (11) (21) and two protruded strips (12) (22) are respectively provided on both planes of the fixed jaw (10) and the movable jaw (20) facing to each other, so that when both of the fixed jaw (10) and the movable jaw (20) are overlapped on each other, the protruded strips (12) (22) rest in their relative channels (11) (21). Two long and narrow holes (13) (23) are respectively provided at the bottom of those two channels (11) (21) and two fixation holes (14) (24) are respectively provided on the opposite ends of those two protruded strips (12) (22) so that when both of the fixed jaw (10) and the movable jaw (20) are overlapped on each other, two rivets (15) (25) are used to respectively penetrate through those two fixation holes (14) (24) and long holes (13) (23) to define a constant relation of relatively lateral slide between those two jaws (10) (20). Within the defined relation, the movable jaw 920) may laterally slide in a given direction and two clamping parts (16) (26) of those two jaws (10) (20), form a clamping space (30).

A spring (40) is placed in two lateral spring troughs (17) (27) respectively provided on the planes of those two jaws (10) (20) facing to each other. Under normal condition, those two clamping parts (16) (26) of the fixed jaw (10) and the movable jaw (20) separate from each other due to the tension provided by the spring (40) to define the maximal clamping space (30) for the wrench of the present invention.

A locking gear (51) having a V-shape has provided at one end a ratchet (52) and a dial (53) on another end. A torsion spring (54) is provided to control the reciprocal circulation of the locking gear (51). One end of the torsion spring (54) is fixed at the locking gear (51) and the other end of the torsion spring (54) is fixed to a hole (181) pre-bored on the fixed jaw (10), and a fixation member (55) is used to penetrate through the torsion spring (54) and the locking gear (51) to be riveted at the fixed jaw (10) while allowing the locking gear (51) to rotate with the fixation member (55) as the center. Furthermore, a fluted surface (28) is provided at the lower edge of the movable jaw (20) to engage the ratchet (52) of the locking gear (51) to fix the movable jaw (20) at a pre-defined location.

Figure 5:
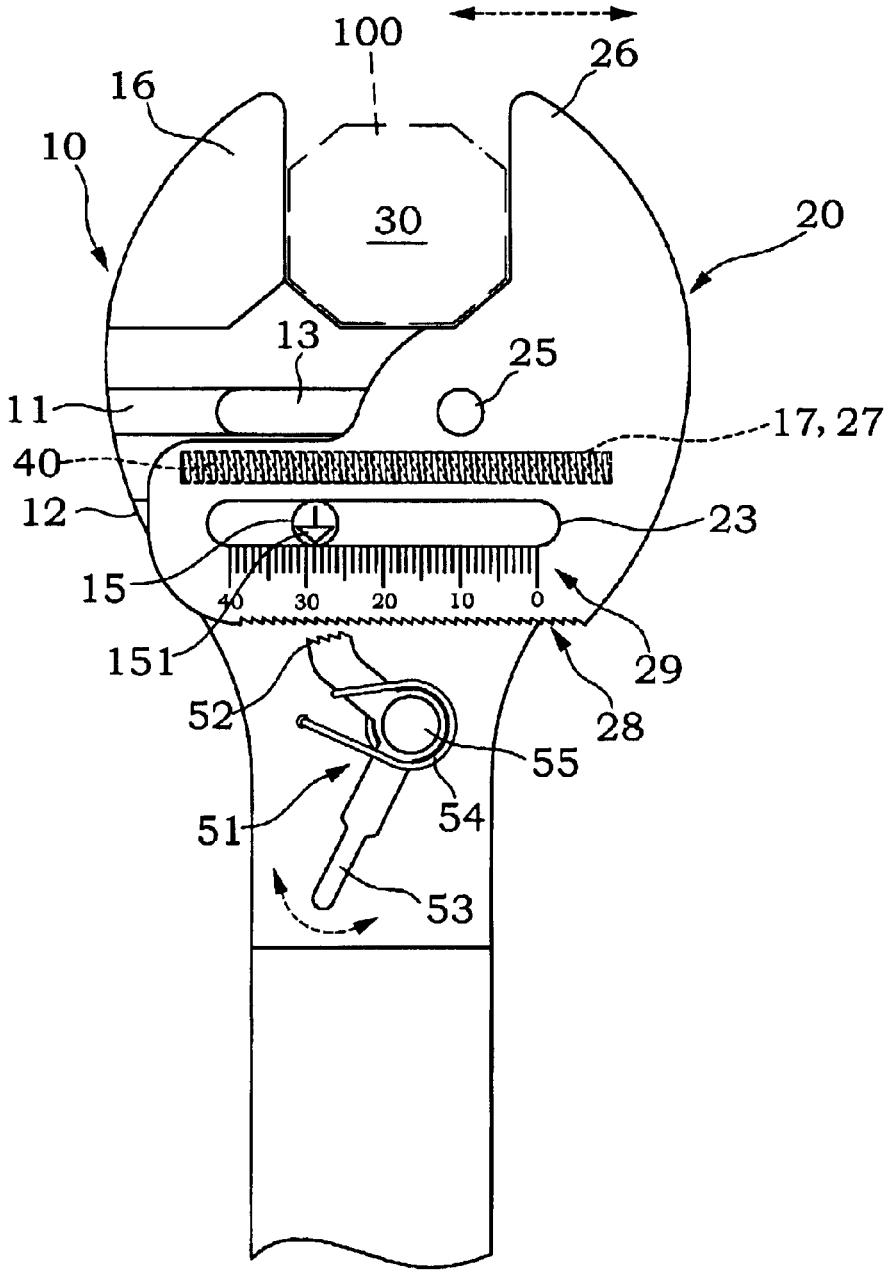
FIG. 5 is a schematic view showing the preferred embodiment of the present invention in use.

Now referring to FIG. 5, when the open end wrench is used, the movable jaw (20) is pushed inward depending on the size of a work piece for the clamping space (30) to fit the work piece (100). The operator may choose to dial away the locking gear (51) or not. If the locking gear (51) is not dialed, the fluted surface (28) of the movable jaw (20) will push away the ratchet (52) and a sound of pushing against the ratchet (52) can be heard when the movable jaw (20) is pushed inwardly depending on the orientation respectively of the fluted surface (28) and the ratchet (52) as illustrated in FIG. 4B. On the other hand, when the movable jaw (20) travels in the opposite direction, the fluted surface (28) is interlocked with the ratchet (52). Accordingly, when the movable jaw (20) travels to its preset location, the fluted orientation causes the movable jaw (20) to be interlocked with the ratchet (20), meaning that the movable jaw (20) is firmly restricted by the locking gear (51) to be held at its preset location.

To release the work piece (100), the operator using his finger to dial the dialer 53 of the locking gear (51) for the ratchet (52) to clear away from the fluted surface (28) of the movable jaw (20). When the movable jaw (20) becomes free, the spring 40 below it returns to push outwardly the movable jaw (20) and the work piece (100) is released once the clamping space (30) is expanded. Once the dialer becomes free, the locking gear (51) automatically returns to the status of having the ratchet (52) to be restricted by the fluted surface (28) of the movable jaw (20) due to the return force exercised by the torsion spring (54).

To facilitate adjusting for a proper clamping space (30), an index (29) may be provided on the surface at the lower edge of the movable jaw (20), and an index mark (151) on the rivet (15) nearest to the index (29) so to indicate the size of the clamping space (30) by the relation between the index (29) and the index mark (151).

To sum up, the present invention provides the following advantages:

a. With the compact structure of the fixed jaw (10) and the movable jaw (20), manufacturing and assembly of the present invention become easy and allow easy control of its precision.

b. Upon clamping the work piece (100), it takes only to push inwardly the movable jaw (20) for it to be restricted by the ratchet (52) of the locking gear (51) for providing a clamping space (30) of a fixed size. While releasing the work piece (100), it takes only to dial the locking gear (51) and the movable jaw (20) automatically clears away from the work piece (100) to allow fast and simple operation of the wrench.

c. Since the locking gear (51) is provided on the upper surface of the wrench, it is unlikely for the work piece (100) to touch the locking gear (51) by mistake so that the locking gear (51) maintains its status to restrict the movable jaw (20). Accordingly, while operating the work piece (100), the wrench will not easily slip off the work piece (100).

d. Within its given range, the movable jaw (20) can be adjusted as desired to fit any size of work piece (100) within that range.

e. The present invention permits easy and convenient operation for the operator as he or she is able to use his or her thumb to dial the dialer (53) of the locking gear (51) while holding the wrench by the same hand.

I claim:

1. An open end wrench comprising; a fixed jaw and a movable jaw; wherein, a constant relation of lateral slide between both jaws being defined, and the surface at the lower edge of the movable jaw being fluted;

a spring being provided between the fixed jaw and the movable jaw to define a clamping space between a clamping part and another clamping part respectively from the fixed jaw and the movable jaw under normal status; and a locking gear being movably disposed on the fixed jaw and having one end adapted with a ratchet to engage the fluted surface of the movable jaw, and another end adapted with a dialer to separate the ratchet and the fluted surface wherein, two lateral channels and two protruded strips are provided respectively on both planes of the fixed jaw and the movable jaw facing to each other; both strips resting in their respective channels when both of the fixed jaw and the movable jaw being incorporated to each other.

2. An open end wrench as claimed in claim 1, wherein, two long holes being each respectively being provided at the bottom of both channels; two fixation holes being each respectively provided at the opposite ends of both protruded strips; and both of the fixed jaw and the movable jaw constituting a relatively lateral slide relation by having two rivets to respectively penetrate through those two fixation holes and two long holes.

3. An open end wrench as claimed in claim 1, wherein, an index is provided on the surface of the movable jaw.

4. An open end wrench as claimed in claim 3, wherein, the index is provided on the lower edge of the surface of the movable jaw.

5. An open end wrench as claimed in claim 4, further comprising an indexing mark provided on the end of a rivet on the fixed jaw.

6. An open end wrench as claimed in claim 1, wherein the locking comprises a V-shape structure.

7. An open end wrench as claimed in claim 1, wherein, a fixation member penetrates through the locking gear and is pivoted through the fixed jaw.

8. An open end wrench as claimed in claim 7, wherein, a torsion spring is provided between the fixation member and the locking gear.

9. An open end wrench as claimed in claim 8, wherein, one end of the torsion spring is fixed at the locking ear and another end of the torsion spring penetrates through a hole pre-bored in the fixed jaw.

10. An open end wrench as claimed in claim 1, wherein, the orientation respectively of the fluted surface and the ratchet allows the movable jaw to be pushed towards the fixed jaw; and the fluted surface and the ratchet are interlocked to each other when the movable jaw travels in opposite direction.

11. An open end wrench as claimed in claim 1, wherein, the fixed and the movable jaws relation relative to each other.

12. An open end wrench as claimed in claim 11, wherein, the spring is provided in two spring troughs respectively disposed facing to each other from the fixed jaw and the movable jaw and wherein both spring troughs travel in a direction in parallel with that of the movable jaw.

13. An open end wrench as claimed in claim 12, wherein under the normal status, both clamping parts respectively from the fixed jaw and the movable jaw define a maximal clamping space due to the tension exercised by the spring.

* * * * *